US011414159B2

(12) United States Patent
Vanberg et al.

(10) Patent No.: US 11,414,159 B2
(45) Date of Patent: Aug. 16, 2022

(54) MOORING DEVICE

(71) Applicant: THE HOOKCUPS GROUP, INC., Calabasas, CA (US)

(72) Inventors: Randy Eric Vanberg, Edmonton (CA); John Scott Roberts, Leduc (CA); Sandeep Aare, Pune (IN); Pankaj V. Pednekar, Pune (IN)

(73) Assignee: The HookCups Group, Inc., Humble, TX (US)

( * ) Notice: Subject to any disclaimer, the term of this patent is extended or adjusted under 35 U.S.C. 154(b) by 0 days.

(21) Appl. No.: 17/699,739

(22) Filed: Mar. 21, 2022

(65) Prior Publication Data

US 2022/0212758 A1 Jul. 7, 2022

Related U.S. Application Data

(63) Continuation-in-part of application No. 17/673,614, filed on Feb. 16, 2022, which is a continuation-in-part of application No. 17/507,079, filed on Oct. 21, 2021, which is a continuation of application No. 17/219,853, filed on Mar. 31, 2021.

(60) Provisional application No. 63/018,368, filed on Apr. 30, 2020.

(51) Int. Cl.
*B63B 21/00* (2006.01)

(52) U.S. Cl.
CPC ..... *B63B 21/00* (2013.01); *B63B 2021/001* (2013.01); *B63B 2021/006* (2013.01)

(58) Field of Classification Search
CPC ..... B63B 21/00; B63B 2021/001; B63B 2021/006
See application file for complete search history.

(56) References Cited

U.S. PATENT DOCUMENTS 3,974,794 A * 8/1976 Kakitani ..... B63B 59/02 114/230.17
5,676,085 A * 10/1997 Michl, Jr. ..... B63B 21/00 114/230.17
6,561,113 B2 * 5/2003 Leise ..... B63B 21/00 114/221 R
7,229,059 B1 * 6/2007 Hood ..... F16M 13/022 248/205.8
7,293,519 B2 * 11/2007 Montgomery ..... E02B 3/20 114/230.1

(Continued)

OTHER PUBLICATIONS

Schmalz, Catalog-Components.pdf, pp. 110-113, unofficial indicated date of publication Jul. 2018 (link for 668 page catalog https://www.schmalz.com/site/binaries/content/assets/media/05_services/catalog/va/Catalog-Components.pdf.

*Primary Examiner* — S. Joseph Morano
*Assistant Examiner* — Jovon E Hayes
(74) *Attorney, Agent, or Firm* — Rao DeBoer Osterrieder, PLLC; John M. DeBoer

(57) ABSTRACT

A mooring device with a rod having a first rod end and a second rod end. There is a suction cup assembly having a first suction cup mount with a first mount end and a second mount end. The first mount end is coupled with the first rod end. The assembly also has a first suction cup coupled with the second mount end. The mooring device includes a coupler engaged with the rod. The coupler is configured for at least one of lateral movement with respect to the rod, rotational movement with respect to the rod, and combinations thereof.

20 Claims, 14 Drawing Sheets

(56) References Cited

U.S. PATENT DOCUMENTS

| | | | | |
|---|---|---|---|---|
| 7,637,222 | B1 * | 12/2009 | Keely | B63B 21/00 114/230.17 |
| 9,027,496 | B2 * | 5/2015 | Zucco | E02B 3/20 114/230.15 |
| 9,199,696 | B1 * | 12/2015 | Bonell | B63B 21/00 |
| 11,319,029 | B2 * | 5/2022 | Logan | B63B 21/20 |
| 11,319,031 | B1 * | 5/2022 | Perry | B63B 59/00 |
| 2009/0230686 | A1 * | 9/2009 | Catlin | F03B 13/264 290/54 |
| 2016/0340948 | A1 * | 11/2016 | McCullough | E05C 19/00 |
| 2021/0371051 | A1 * | 12/2021 | Givens | B63B 21/00 |

* cited by examiner

MOORING DEVICE

STATEMENT REGARDING FEDERALLY SPONSORED RESEARCH OR DEVELOPMENT

Not applicable.

BACKGROUND

Field of the Disclosure

This disclosure generally pertains to a mooring device, with related apparatuses, methods, and systems, where the mooring may be between multiple objects, such as two floating vessels. In particular embodiments, the disclosure relates to improved mooring between two or more adjacent boats.

Background of the Disclosure

In the related art, it has been known to use tethering devices to moor or dock various types of boats to fixed structures such as docks or buoys, as well as to attach boats to one another. These tethering devices are sometimes difficult to install and/or sometimes fail to securely hold their associated boat securely to the fixed structure or other boat. Some improvements have been made in the field. Examples of references related to the present invention are described below in their own words, and the supporting teachings of each reference are incorporated by reference herein.

Conventional devices might use a vacuum operated mooring device consisting of a telescopic and lockable connecting arm, to connect and hold apart at a distance, one boat from another or a boat from a dock. At both extremities of the connecting arm might single and multiple axes connected to manually operated vacuum devices that produce a continuous supply of vacuum, within limits, and supply the vacuum to rubber suction cups attached to the boats. Other devices might be used to connecting boats to fixed structures or to one another, the device having attachment points of which connect to the cleats on the boat(s) and/or structure.

It is often desirable to attach two items together ensure proximity, while at the same time maintaining a gap or spacing between the items. One example of such a situation is when boaters wish to float with other boaters and maintain boats close to one another, but not allow the boats to make contact with each other.

Especially when the items being connected are floating, connecting two items with a desired spacing poses some challenges. A typical means of connecting boats, for example, involves fastening lines to steering wheels of boats and tying into cleats or fenders. Often these lines, fenders, buoys, and the like would not stay in place, and these methods do not stop the boats from making contact with each other and potentially causing damage or even injuring persons who happen to be in between the boats (or any other items connected in this manner).

Further, items without flat surfaces pose challenges for connecting to and with other items. For example, pontoons on boats or on amphibious aircraft, personal watercraft, inner tubes, canoes, kayaks, bumpers on cars, trailers, windshields, various materials handling tasks, and the like often have rounded and/or otherwise irregular shapes which are typically not conducive for utilizing suction cups.

Maintaining a minimum spacing between items is also complicated when the items move respective to one another. For example, when waves or wakes from watercraft cause items connected with one another to move, the movement may not be in phase, thereby putting a strain on any rigid connection means.

It is desirable, therefore, to have an apparatus which may connect two items and maintain a spacing between the items, while still allowing for a certain degree of movement of the items relative to one another.

However, these devices are known suffer from a number of disadvantages which include: weak holding power, requiring tools to assemble/utilize/install, not being able to float in the water, more likely to disengage, showing boat to come into contact with the attached structure or other boat, not allowing for rotation along two-axis to allow for independent boat movement, not durable, prone to breakage during high-wave circumstances, and causing cosmetic damage to the boat.

What is needed is a mooring device that solves one or more of the problems described herein and/or one or more problems that may come to the attention of one skilled in the art upon becoming familiar with this specification.

SUMMARY

Embodiments of the disclosure pertain to a mooring device configured to couple to or between one or more objects. The target object may have a flat or non-flat (e.g., rounded) surface.

The mooring device may have a rod having a first rod end and a second rod end. The mooring device may have a first suction cup assembly. The cup assembly may include a first suction cup mount having a first mount end and a second mount end. In aspects, the first mount end may be coupled with the first rod end. The first suction cup may be coupled with the second mount end.

The mooring device may have a coupler engaged with the rod. The coupler may be configured with one or more degrees of freedom of movement. In aspects, the coupler may be configured for at least one of lateral movement with respect to the rod, rotational (or pivotal) movement with respect to the rod, and combinations thereof. Other movements may be possible.

The rod may have a rod fluid pathway. The first suction cup mount may have a mount fluid pathway. The first suction cup may have a cup fluid pathway. One or more of the rod fluid pathway, the mount fluid pathway, and the cup fluid pathway may be configured or positioned in fluid communication with each other depending on a position of a valve.

The mooring device may have a (detachable) pump coupled therewith. The pump may be operable to create a movant force, such as suction, which may be used to move the valve to a flow position. With the valve open, fluid may flow through any or all of the rod fluid pathway, the mount fluid pathway, and the cup fluid pathway.

The mooring device may have a second suction cup assembly. The second suction cup assembly may be engaged with the second rod end. There may be one or more bushings engaged with or otherwise disposed around the rod. The one or more bushings may be engaged with the coupler.

The mooring device may have a strut or elongated member. The strut may have a first strut end engaged with the coupler. In aspects, the strut may have a first segment and a segment movingly engaged together. The strut may have a second strut end engaged with another coupler associated with a second suction cup assembly. The strut may have a second strut end engaged with another coupler associated with a hook.

The suction cup of the mooring device may include a cup body having at least one bellows fold extending around an entire circumference of the cup body. The cup may have a sealing edge; an internal surface; and a plurality of cleats positioned on the internal surface of the cup body extending radially inward from proximate the sealing edge.

The thickness of each cleat of the plurality of cleats may increase from end to end. The cup pathway may extend from an interior underside of the cup body to an exterior of the cup body.

Other embodiments of the disclosure pertain to mooring device that may have a rod having a first rod end and a second rod end. There may be a first suction cup assembly. The first cup assembly may have a first suction cup mount having a first mount end and a second mount end. The first mount end may be coupled with the first rod end. There may be a first suction cup coupled with the second mount end.

The mooring device may include a second suction cup assembly. The second suction cup mount may have a respective first mount end and a respective second mount end. The respective first mount end may be coupled with the second rod end. There may be a second suction cup coupled with the respective second mount end.

The mooring device may include a coupler engaged with the rod. The coupler may be configured for at least one of lateral movement with respect to the rod, rotational movement with respect to the rod, and combinations thereof. The mooring device may have a strut having a first strut end engaged with the coupler.

In aspects, the rod may include a rod fluid pathway, the first suction cup mount may include a mount fluid pathway, and/or the first suction cup may include a cup fluid pathway. Any or all of the pathways may be in (selective) fluid communication with one or more of the other pathways, depending on a position of a valve.

A pump may be coupled with the mooring device. The pump may be operable to create a vacuum within the one or more fluid pathways. In this manner, an external surface of the first suction cup may be sealingly coupled with a target surface of a first object. There may be an at least one bushing is disposed around the rod, and engaged with the coupler. In aspects, the strut may include a first segment and a second segment movingly engaged together.

Any suction cup of the mooring device may have a bellows fold extending around an entire circumference of the cup body. The suction cup may include a sealing edge; an internal surface; and a plurality of cleats positioned on the internal surface of the cup body extending radially inward from proximate the sealing edge. The cup fluid pathway may extend from an interior underside of the cup body to an exterior of the cup body.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
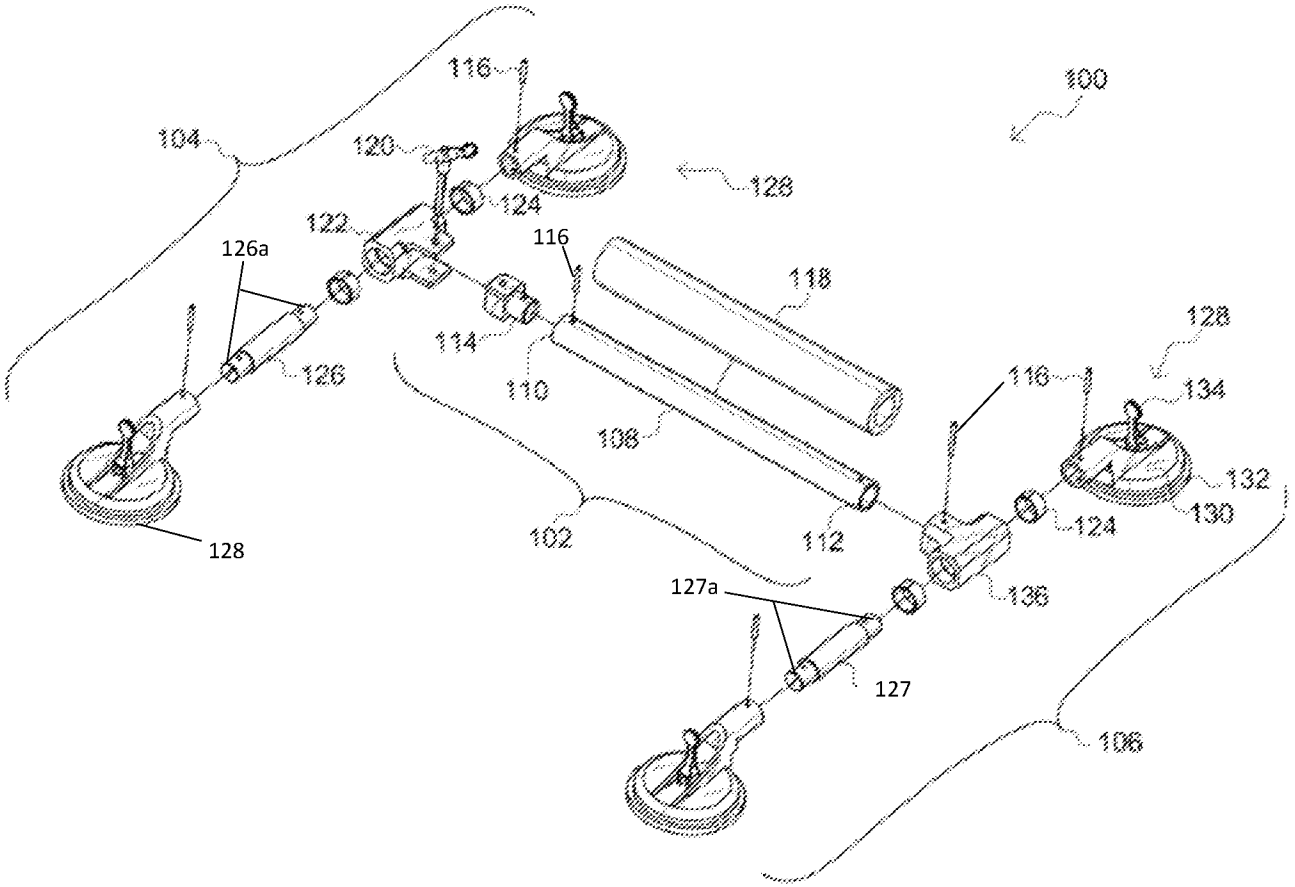
FIG. 1 shows an exploded view of a mooring device according to embodiments of the disclosure.

Regardless of whether presently claimed herein or in another application related to or from this application, herein disclosed are novel apparatuses, units, systems, and methods that pertain to mooring one or more objections together, such as boat-to-boat, details of which are described herein.

The figures may show a mooring device of similar or identical nature. While it need not be exactly the same, the depicted mooring device may be like that of device 200, 100 etc., and components thereof may be duplicate or analogous. Thus, only a brief discussion of any particular mooring device may be provided, recognizing that differences, if any, would be discernable by one of skill in the art, especially in view of the present disclosure.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. It is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Without limitation otherwise, the make and manufacture of any particular component, subcomponent, etc., described herein may be as would be apparent to one of skill in the art, such as molding, forming, press extrusion, machining, additive manufacturing, etc. Components, subcomponents, etc. may be metallic, plastic, composite, and so forth, and need not all be of the same material. Embodiments of the disclosure provide for one or more components to be new, used, and/or retrofitted to existing machines and systems.

For any embodiment of the disclosure, associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof. Any component herein that utilizes power or automation may be provided with wiring, tubing, piping, etc. in order to be operable.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. "Mounted" and "connected" may be analogous or identical.

The term "mooring" or "moored" as used herein may refer to a coupling or connecting between one or more objects. In the nautical sense, "moored" may refer to 'make fast', which is akin to connecting or coupling. For example, a boat may be moored (coupled) to an object, such as a pier or cleat. A mooring device as used herein may refer to a device, apparatus, system, etc. suitable for coupling an object to something else. The object may be floating vessel, such as a boat or tube.

The term "pipe", "conduit", "line", "tubular", "hose", or the like as used herein may refer to any fluid transmission means, and may (but need not) be tubular in nature. The term may also apply to other forms of transmission, such as electrical.

The term "composition" or "composition of matter" as used herein may refer to one or more ingredients, components, constituents, etc. that make up a material (or material of construction). Composition may refer to a flow stream of one or more chemical components.

The term "valve" as used herein may refer to a valve configured to control flow of a fluid, or the like through the valve by varying the size of the flow passage. The opening or closing of a valve may be by manual, automatic, electrical, hydraulic, or pneumatic actuators, or the like.

The term "pneumatic" as used herein may refer to a device or piece of equipment operable or otherwise responsive to some form of air (or other suitable gas) pressure.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pump" as used herein may refer to a mechanical device suitable to use an action such as suction or pressure to raise or move liquids, compress gases, and so forth. 'Pump' may further refer to or include all necessary subcomponents operable together, such as impeller (or vanes, etc.), housing, drive shaft, bearings, etc. Types of pumps include hand-operated, manual, suction gas powered, hydraulic, pneumatic, electrical, etc.

The term "utility fluid" as used herein may refer to a fluid used in connection with the operation of a creating a suction or vacuum (by removal thereof). 'Utility fluid' may also be referred to and interchangeable with 'service fluid' or comparable. The utility fluid may be air or other type of compressible fluid.

The term "machined" may refer to a computer numerical control (CNC) process whereby a robot or machinist runs computer-operated equipment to create machine parts, tools and the like.

The term "strut" as used herein may refer to a rod or other form of elongated member. The strut need not be linear (straight), need not be rigid, and need not be cylindrical.

Referring now to FIG. 1, an exploded view of a mooring device, illustrative of embodiments disclosed herein, is shown. The mooring device may be contemplated as a suction cup mooring device or a mooring device that has one or more suction cups. FIG. 1 shows there may be a mooring device 100 including a strut 102 pivotally coupled on a first end 110 to a first head 104 and rigidly coupled on a second end 112 to a second head 106.

The illustrated strut 102 includes a hollow tube 108 rigidly coupled on a first end 110 to a mount 114. As illustrated, the strut 102 and the mount 114 have one or more respective holes, upon which being lined up, dowels (or other types of securing members, such as pins, screws, nails, etc.) 116 may be pressed into to secure them to each other. In other embodiments, there may be more than one strut 102 or hollow tube 108, the hollow tube 108 or strut 102 may be selectably extendable though telescoping or having a hinge, ball joint, or other rotating or pivoting connection, and or the hollow tube 108 may be a solid piece, a tube filled with a buoyant material, and the like and combinations thereof.

The illustrated hollow tube 108 may be enclosed within a flotation sleeve 118, which includes an integrated cover sleeve for protection and aesthetics, however in other embodiments, the cover sleeve may be separated front the flotation sleeve 118. The flotation sleeve 118 and/or the cover sleeve may be slit down one or more sides to enable easy install, replacement, and upgrade. The flotation sleeve 118 and the cover sleeve may be fitted with hook and loop fasteners, straps, buttons, clips, and the like and combinations thereof in order to securely remain in place once installed over or around the flotation sleeve 118 and the hollow tube 108.

The flotation sleeve 118 may also be another buoyant object, such as a buoy or one or more flotation rings encircling or otherwise connected to the strut 102. The volume of the flotation sleeve 118 may be selected to counter any negative buoyancy of the mooring device 100 and to result in a net positive buoyancy for the entire device. This volume may be determined by progressively attaching larger sleeves until positive buoyancy may be achieved or may be determined by weighing the mooring device 100 while submerged in water to determine total negative buoyancy and then selecting a sleeve size that has greater positive buoyancy than the determined negative buoyancy.

The illustrated first head 104 includes a detent pin 120 and a tabbed pipe 122, which has a respective hole sized similarly to one in the mount 114 through which the detent pin 120 may be inserted, rotatably coupling the first head 104 to the strut 102. The tabbed pipe 122 also has bushings 124 inserted into each opposing end. A rod 126 may be inserted through the bushings 124 and tabbed pipe 122, may rotate therein, and has a rod end 126*a* on each side protruding from the tabbed pipe 122. The rod 126 may be selectably extendable, such as being telescopic, so as to allow the user additional flexibility with mounting locations.

Suction cups 128 may be coupled (such as removably or rigidly) to respective protruding ends 126*a* of the rod 126. The cups 128 may rotate in conjunction with the rod 126. The suction cups 128 and rod 126 may have one or more respective holes, upon which being lined up, dowels 116 may be pressed into to secure them to each other.

The illustrated suction cups 128 include a base 130, a pad 132, and a lever 134. The base 130 provides a stable mounting point for the pad 132 and the lever 134 as well as allows pressure to be evenly and accurately applied to the suction cups 128 to enable easy mounting. The base 130 also has a through hole (not viewable here) where it mounts to the pad 132 and to the lever 134.

The illustrated pad 132 may be mounted to one side of the base 130 and may be concave in shape in order to create a pressurized sealed area when pressed against a surface, such as boat hull; however, the pad 132 may also have other shape mating surfaces, such as flat. The pad 132 may be made of a flexible material, which may facilitate creation of a good seal when pressed against a target surface (e.g., boat hull). Flexibility may account for and accommodate any imperfections or surface differences on the target surface. Such materials may include, but are not limited to rubber, silicone, soft plastics, and the like and combinations thereof. The pad 132 may also be coated with substances to assist in creating a seal or to protect the pad 132 from the elements, such as oils, petroleum jellies, UV protectants, and the like and combinations thereof. The pad 132 may have a through hole (not viewable here) where it mounts to the base 130.

The illustrated lever 134 may be mounted to the side of the base 130 opposite the pad 132, however in other embodiments may be mounted elsewhere on the base 130. The lever 134 may be configured to pull up on the suction cups 128 to create a pressure differential and/or open and close the hole in the base 130 and the pad 132, thereby allowing the suction cups 128 to maintain a negative pressure differential compared to the outside pressure, enabling it to cling to the target or other mounted surface. The lever 134 may also be spring loaded or otherwise biased open or shut to assist the user in using the lever 134 or to prevent the lever 134 from continuously moving back and forth when not in use.

The illustrated second head 106 includes a tee 136, which has a hole through which a dowel may be inserted, coupling the second head 106 to the strut 102. The tee 136 also has bushings 124 inserted into each opposing end. A second head rod 127 may be inserted through the bushings 124 and the tee 136, may rotate therein, and has respective rod ends 127*a* on each side protruding from the tee 136. Suction cups 128 may be coupled to the one or both protruding ends 127*a* of the rod 127. The cups 128 may rotate in conjunction with the rod 127.

Although the illustrated embodiment may be shown with four suction cups, various numbers of suction cups may be used depending on the desired use, such as singular suction cups, arrays of suction cups, and the motion cups may be arranged so as to add or reduce the rigidity of the mounting, such may be triangular arrangements to promote strength in all directions, or linearly to allow the suction cups to break free if there may be too much stress in one direction.

In other embodiments, one or more of the dowel-in-hole connections of the mooring device 100 may be configured to receive other fastening mechanisms such as pins, rivets, ball detents, screws, set screws, and the like and combinations thereof. Other embodiments may instead have one or more of the connections create via threading together, adhesives, epoxies, press fitting, latching, and the like and combinations thereof.

The structural pieces of the mooring device 100 may be made of any material with a high strength-to-weight ratio, such as metals, hard plastics, wood, and the like and combinations thereof. These materials may be plated, coated, or painted to assist in preventing exposure damage such as corrosion or UV damage. With respect to flotation sleeve 118, it may be made of any material that provides buoyancy, such as foams, woods or plastics, and the like and combinations thereof. The cover sleeve may be made of fabric or flexible plastic and the like and combinations thereof. The flotation sleeve 118 and cover sleeve may also be coated or impregnated with a chemical solution, oil, or metal to help them be UV, mildew, and/or water resistant.

In operation, the suction cups 128 of the first head 104 may be pressed onto the target surface, such as a hull of a first floating vessel or boat. Once the suction cups 128 are pressed against the target surface, the user presses down the lever 134 on each of the suction cups 128 of the first head 104, which each act as a mechanical vacuum actuator, and rigidly secures suction cups 128 to the target surface. Thereafter, the user rotates the second head 106 to line up the suction cups 128 of the second head 106 with a second target surface (for example, another floating vessel or boat). The user then presses the suction cups 128 of the second head 106 against the second target surface and then presses down the lever 134 on each of the suction cups 128 of the second head 106, which each act as a mechanical vacuum actuator, and rigidly secures suction cups 128 to the second target surface. It may also be that installation of second end 112 may be done prior to or concurrently with installation of first end 110.

Another method to install the mooring device 100 may be to pull the pin which connects the tabbed pipe 122 of the first end 110 to the mount 114 of the strut 102. This separates the first head 104 from the strut 102 and second head 106. The suction cups 128 of the first head 104 are then secured to the target surface by engaging the lever 134 of the first end 110, while the suction cups 128 of the second end 112 are secured to the second target surface by engaging the lever 134 of the second end 112. Once the suctions cups of the first end 110 and the second end 112 are secured to the respective surfaces, the mount 114 may be inserted between the flanges of the tabbed pipe 122 and the detent pin 120 may be inserted through the tabbed pipe 122 and the mount 114, thereby securing the first head 104 to the strut 102 and second head 106.

Advantageously, the mooring device 100 may be durable and ready-to-use device that may be able to rigidly couple two boats to one another, while also maintaining a high level of flexibility. This allows mooring device 100 to have a large amount of holding power while also being able to compensate for movement of the boats without allowing them to make direct contact with one another. The device thereby both keeps the boats separate while also being significantly less likely to disengage from and free the boats or otherwise cause cosmetic damage to the boats.

Figure 2:
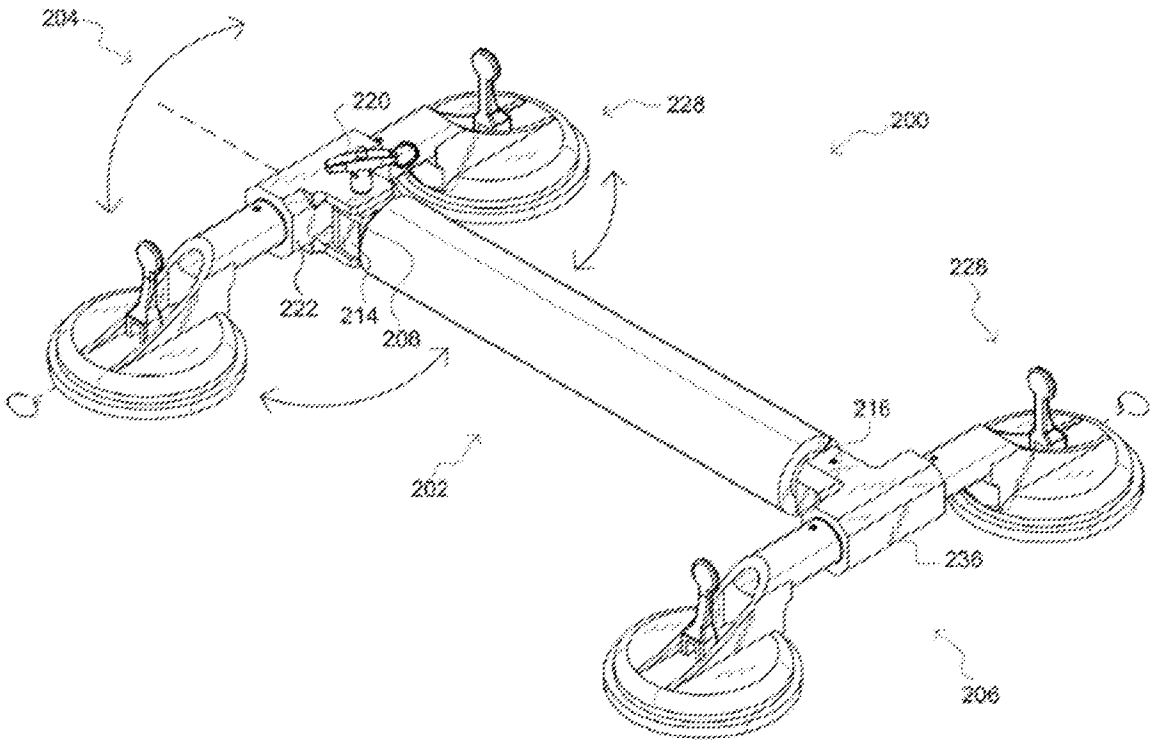
FIG. 2 shows a top perspective view of an assembled mooring device according to embodiments of the disclosure.

Referring now to FIG. 2, a top perspective view of an assembled mooring device, illustrative of embodiments disclosed herein, is shown. FIG. 2 shows the mooring device 200 may have suction cups 228 able to freely rotate relative to the tabbed pipe 222, the suction cups 228 mounted one on each side close to the tabbed pipe 222 to prevent the tabbed pipe 222 from sliding back and forth between the suction cups 228.

While it need not be exactly the same, the mooring device 200 may be like that of device 100 etc., and components thereof may be duplicate or analogous. Thus, only a brief discussion of the device 200 may be provided, recognizing that differences, if any, would be discernable by one of skill in the art, especially in view of the present disclosure.

The mount 214 may be inserted into the tabbed pipe 222, with the detent pin 220 inserted through each, thereby attaching the first head 204 to the strut 202. This allows the first head 204 to pivot relative to the strut 202, and when combined with the rotation of the suction cups 228, gives the first head 204 two axes of motion relative to the rest of the mooring device 200.

The illustrated embodiment shows the hollow tube 208 inserted into the tee 236, with a dowel pin 216 inserted, thereby rigidly attaching the second head 206 to the strut 202. This creates a rigid connecting structure that does not allow the second head 206 to pivot relative to the strut 202, preventing the mooring device 200 from collapsing in on itself, however still allows two connected hosts to pivot, move forwards or backwards relative to one another, or rise and fall relative to one another without putting excessive stress on the parts of the mooring device 200.

Figure 3:
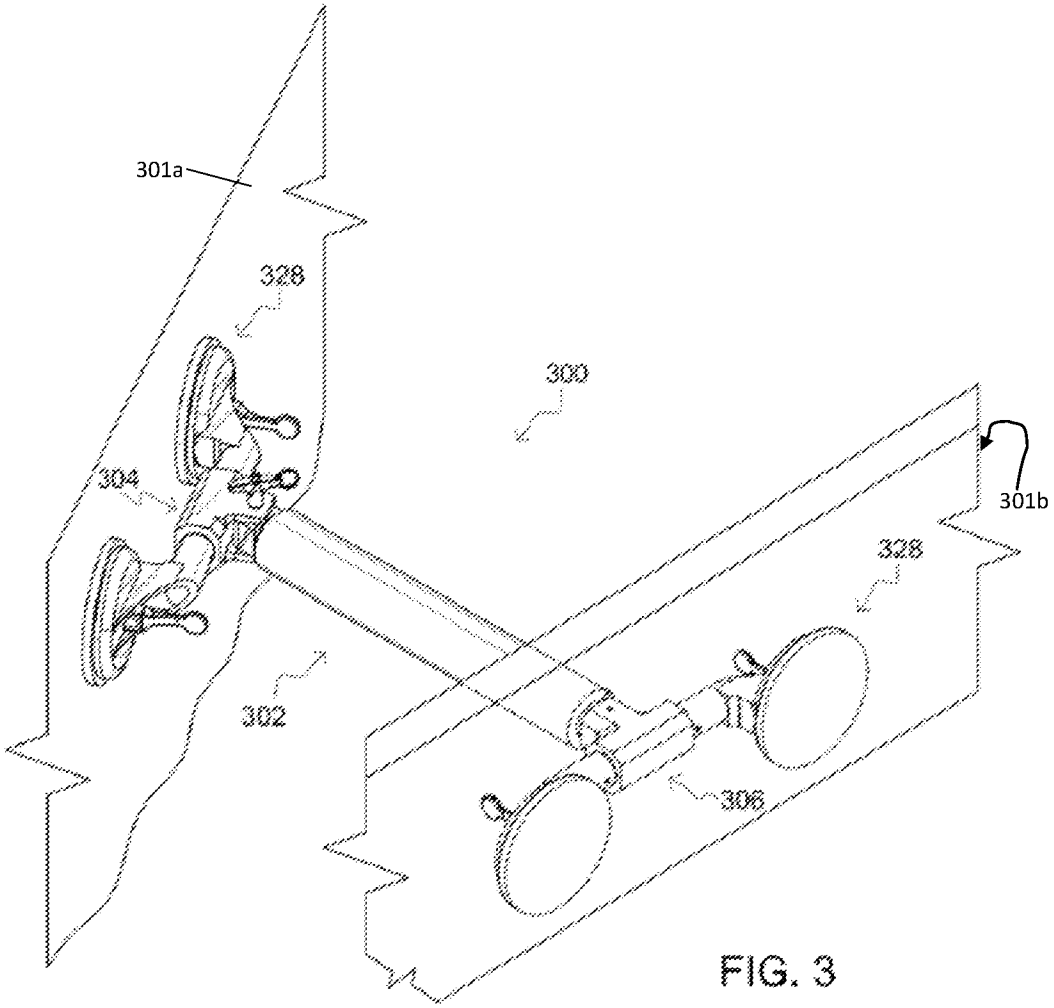
FIG. 3 shows an assembled mooring device in an installed position according to embodiments of the disclosure.

Referring now to FIG. 3, an assembled mooring device in an installed position, illustrative of embodiments disclosed herein, is shown. As shown here, the mooring device 300 may have the suction cups 328 rotated and rigidly attached to one or more target surfaces 301*a*, 301*b*. The first head 304 may be moved (such as pivoted) to accommodate the angle between the suction cups 328 of the first head 304 attached to the first target surface 301*a* and the suction cups 328 of the second head 306 attached to the second target surface 301*b*.

As illustrated, the first head 304 may be pivoted relative to the strut 302, as well as the suction cups 328 are rotated relative to the first head 304. The two axes of motion of the first head 304 allow the mooring device 300 to compensate for movement of the surfaces in the x-axis and y-axis, as well as allows the boats to pivot around the x-axis and y-axis. In embodiments where the connections on the heads 304, 306 or strut 302 are rotatable, movement in the z-axis could also be achieved. The rigidity of the second head 306 connection to the strut 302 allows the movement between the surfaces 301*a*, 301*b* without allowing the mooring device 300 to collapse in on itself. This restricts or prevents the surfaces 301*a*, 301*b* to make direct contact with one another and cause damage.

Figure 4:
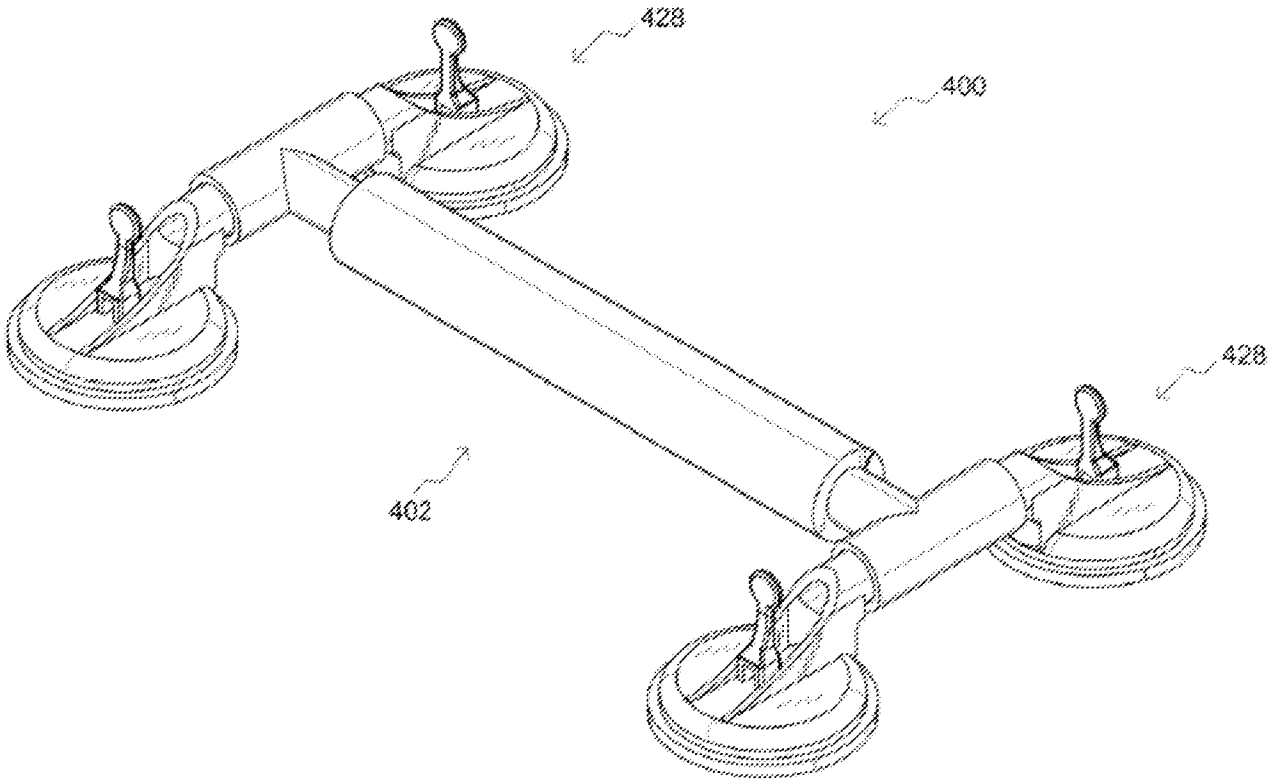
FIG. 4 shows a top perspective view of in assembled mooring device according to embodiments of the disclosure.

Referring now to FIG. 4, a top perspective view of an assembled mooring device, illustrative of embodiments disclosed herein, is shown. As shown here, the mooring device 400 may have a strut 402 that extends all the way to the suction cups 428, which are able to freely rotate relative to the strut 402, the suction cups 428 mounted one each side close to the strut 402 to prevent the strut 402 from sliding back and forth between the suction cups 428.

The illustrated mooring device 400 allows the connected surfaces to rise and fall with one another without being able to move forwards or backwards relative to one another or pivot towards or away from one another, preventing contact between them. This also promotes rigidity and strength in the system, as pin or other connections are replace by solid structure and thus allows the user to keep two surfaces spaced a constant distance from one another.

Figure 5:
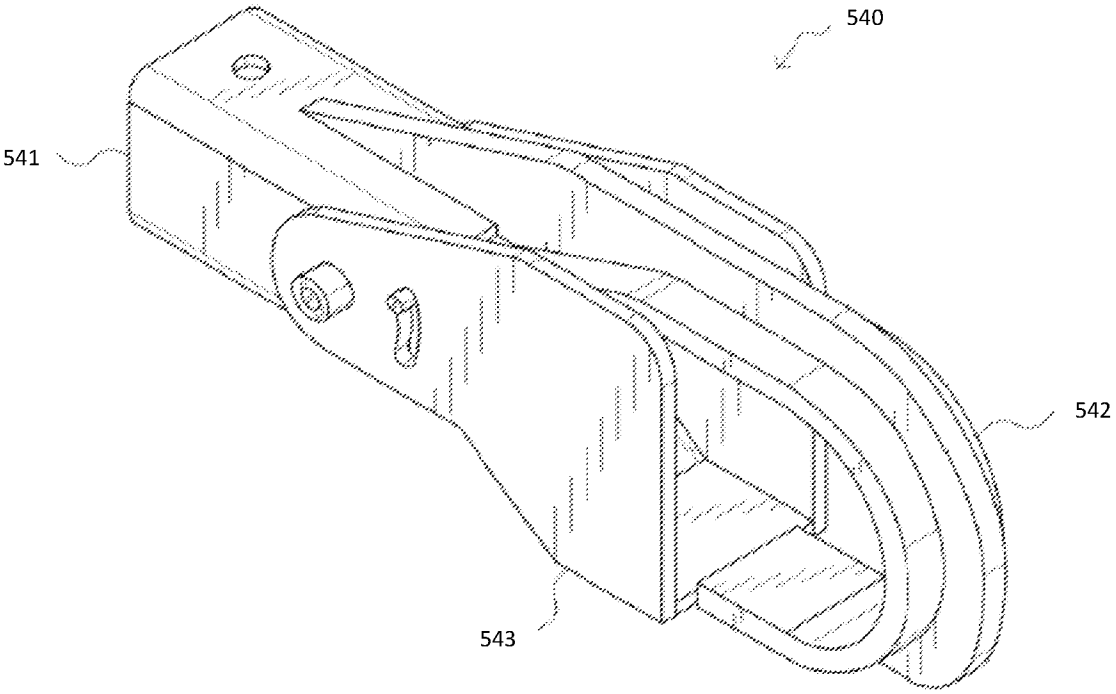
FIG. 5 shows a view of connector of a mooring device according to embodiments of the disclosure.

Referring now to FIG. 5, a view of a connector of a mooring device, illustrative of embodiments disclosed herein, is shown. As shown, the connector 540 may include a mounting end 541, a hook 542, and a safety latch 543. In operational context, such as but not limited to in use with the structure shown in FIG. 1 (or for other embodiments of the disclosure), the mounting end 541 on one side may be pivotally connected to the mount 114 of the first end 110 of the strut 102 through a pin connection or the like. The connector 540 may also rigidly couple to the second end 112 of the strut by pressing a dowel through the hole in the second end 112 and the mounting end 541. The mounting end 541 may have a different shape, such as round, oblong, polygonal, and the like in order to securely couple to different shaped mounts 114, first ends 110, or second ends 112.

The illustrated hook 542 may be rigidly connected to the mounting end 541 through a weld, however, may also be connected by any number of mechanical fasteners such as bolts, rivets, screws, press fit, and the like and combinations thereof. The hook 542 may also be formed with the mounting end as one piece to negate the need for fastening the pieces together. The hook 542 may have a spine to increase the strength of the hook 542 without drastically increasing the weight thereof.

The illustrated safety latch 543 may be connected (such as pivotally) to the mounting end 541, for example, through a bolt. The safety latch 543 may pivot relative to the mounting end 541 to open and close access to the hook 542. The safety latch 543 may include a spring or torsion spring to bias the safety latch 543 open or closed and nay also include a pin or latch to hold the safety latch 543 open or lock it shut.

To use the illustrated connector 540, the user presses the bottom of the safety latch 543 on an object, such as a cleat, hook, ring, or the like, which biases the safety latch towards the open position and moves the object past interference with the hook 542. Once the object may be clear of the hook 542, the user pushes the object forward or the connector 540 backwards until the object may be clear of the front of the safety latch 543. Without the user biasing the safety latch 543 open, the torsion spring in the safety latch 543 then biases the safety latch 543 shut, which locks the object within the connector 540.

To remove, the user biases the safety latch 543 open and then pushes the object backwards or the connector 540 forwards until the object may be clear of the tip of the hook 542. The user then pushes the object down or the connector 540 up until the object my be clear of the bottom of the hook 542.

Figure 6A:
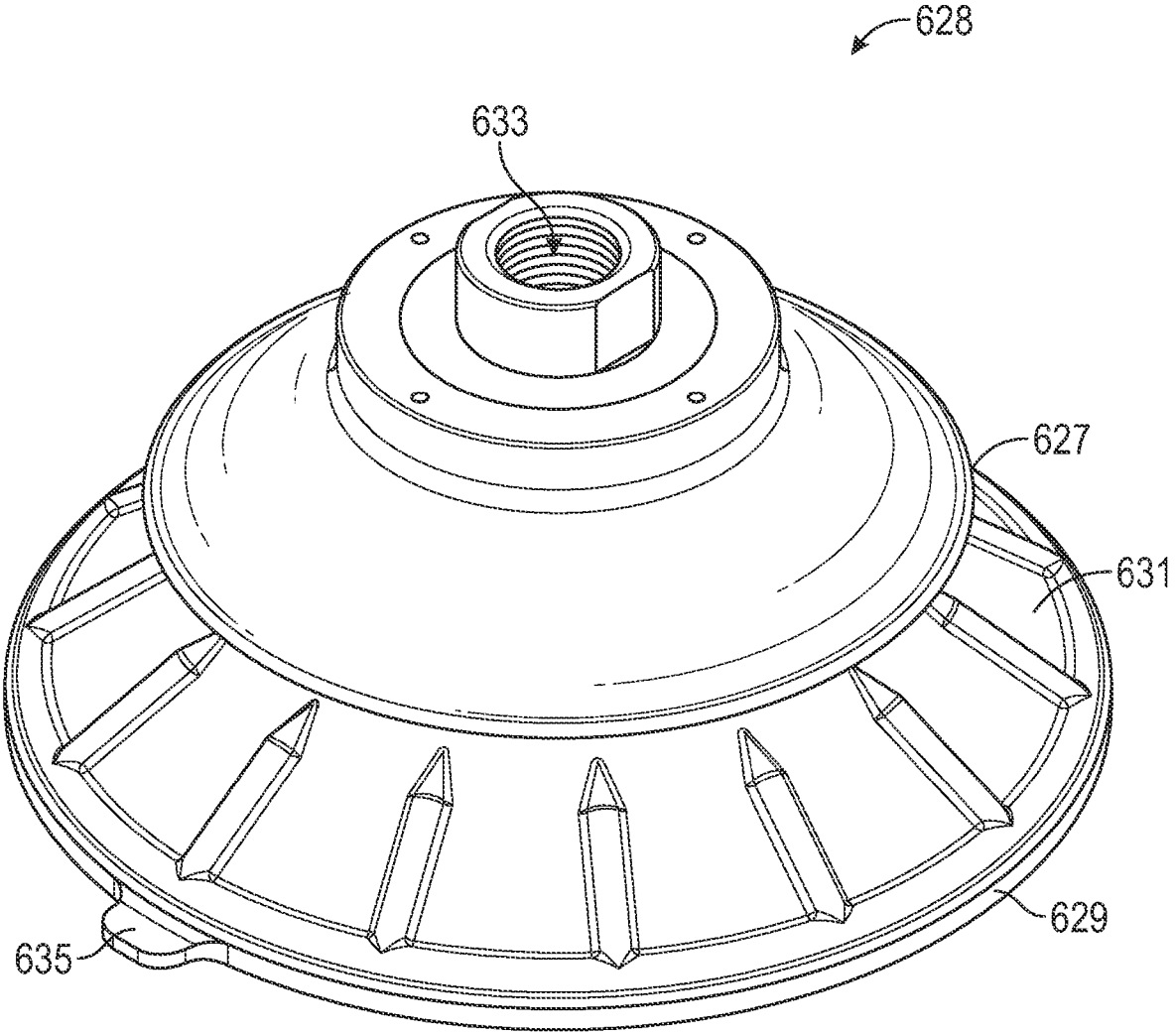
FIG. 6A shows a perspective view of the external surface of an embodiment of a suction cup according to embodiments of the disclosure.
Figure 6B:
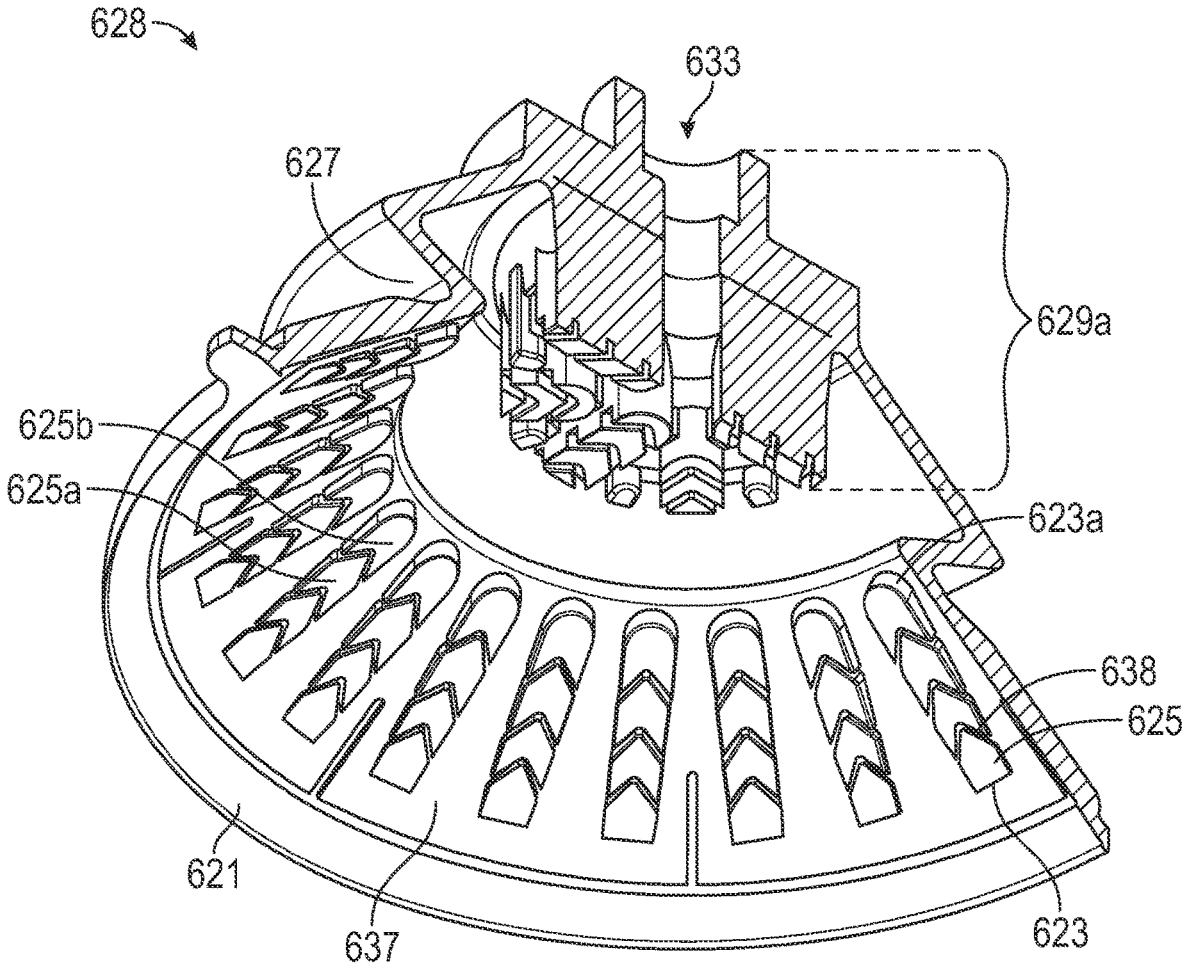
FIG. 6B shows a cut view of the internal surface of an embodiment of a suction cup according to embodiments of the disclosure.
Figure 6C:
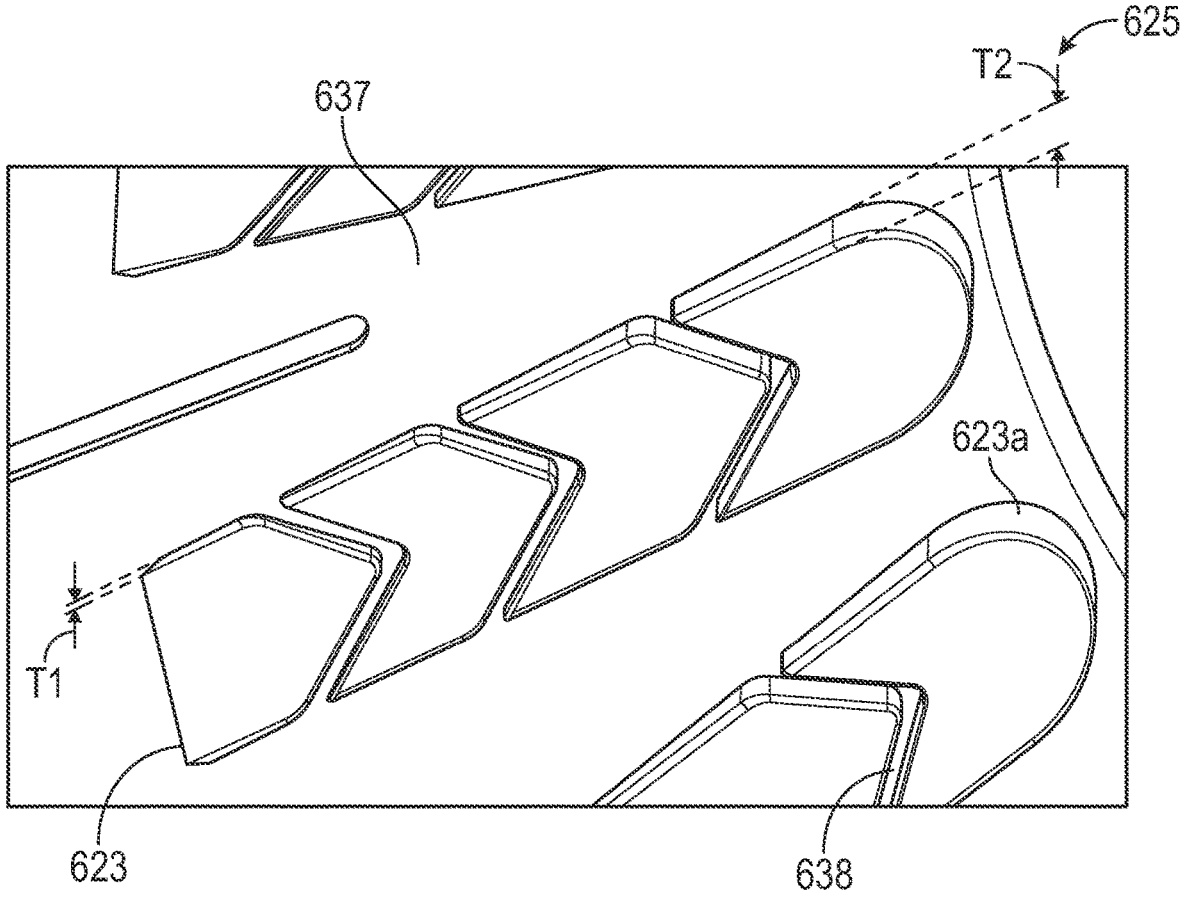
FIG. 6C shows a close-up underside view of a suction cup cleat according to embodiments of the disclosure.

Referring now to FIGS. 6A, 6B, and 6C together, a perspective view of the external surface of an embodiment of a suction cup, a cut view of the internal surface of an embodiment of a suction cup, and a close-up underside view of a suction cup cleat, respectively, illustrative of embodiments disclosed herein, are shown.

FIGS. 6A-6C together show a suction cup 628 having a suction cup body 629. Although the body 629 may be an integral structure as shown, the body 629 may be multi-piece in construction and configuration. The suction cup 628 may have at least one bellows fold 627 indenting an external surface 631 of the cup body 629. As one of skill would appreciate, the bellows fold 627 may have concertinaed sides configured to expand and contract the body 629. This movement then facilitates the drawing in or expulsion of a fluid, such as air.

A suction cup fluid pathway 633 may extend or otherwise be disposed into an internal portion 629*a* of the cup body 629. In some aspects, there may a structure such as a pull tab or other protrusion 635 to aid in removing the suction cup 628 after attachment to an object (e.g., 301*a*, FIG. 3).

FIG. 6B in particular shows an underside/cut view of the cup body 629 with fluid pathway 633 and bellows fold 627. As shown, the copy body 629 may have an internal cup surface 637. There may be one or more raised surfaces or cleats 625 disposed or otherwise formed on the internal sup surface 637. The cleats 625 may be disposed in various patterns, such as that shown here. For example, there may be columns of cleats 625 spaced equidistantly to each other. The arrangement of cleats 625 may be symmetrical or asymmetrical. Moreover, any given cleat 625 may have a different shape from that of other cleats (compare 625*a* and 625*b*).

In embodiments, the cleat 625 may have a first cleat end 623 closer to a sealing edge 621 of the cup body 629. An other or second cleat end 623*a* of a respective cleat (further from the sealing edge 621 and closer to the bellows fold 627) may be thicker than the first end 623. Thus, there may be a first cleat with first thickness T1, and a second cleat with second thickness T2. The first thickness T1 may be less than second thickness T2, or vice versa. In some aspects, the thickness may be equal (or approximately thereto). Adjacent cleats 625 may have one or more indentations or passages 638, which may facilitate fluid flow therethrough passages 638, and thus facilitate or promote fluid flow.

The indentation 638 may be of any shape as desired by persons having ordinary skill in the art as suitable for the specific application. A chevron shaped indentation 638 is shown here. This type of shape may provide for desirable flow profile when fluid (e.g., air) is pumped out of the suction cup to help form a tighter and more efficacious seal at the sealing edge 621 between the cup body 629 and an object (301*a*). The varied thickness T1, T2 of respective cleats 625 may provide for a greater void between the internal surface 637 (of the suction cup) and the object it is attached to. This varied thickness may create a desirable flow profile when fluid is pumped out of the volume of space between the underside of the suction cup and the target object, as the cup 628 is adhered thereto.

Figure 7A:
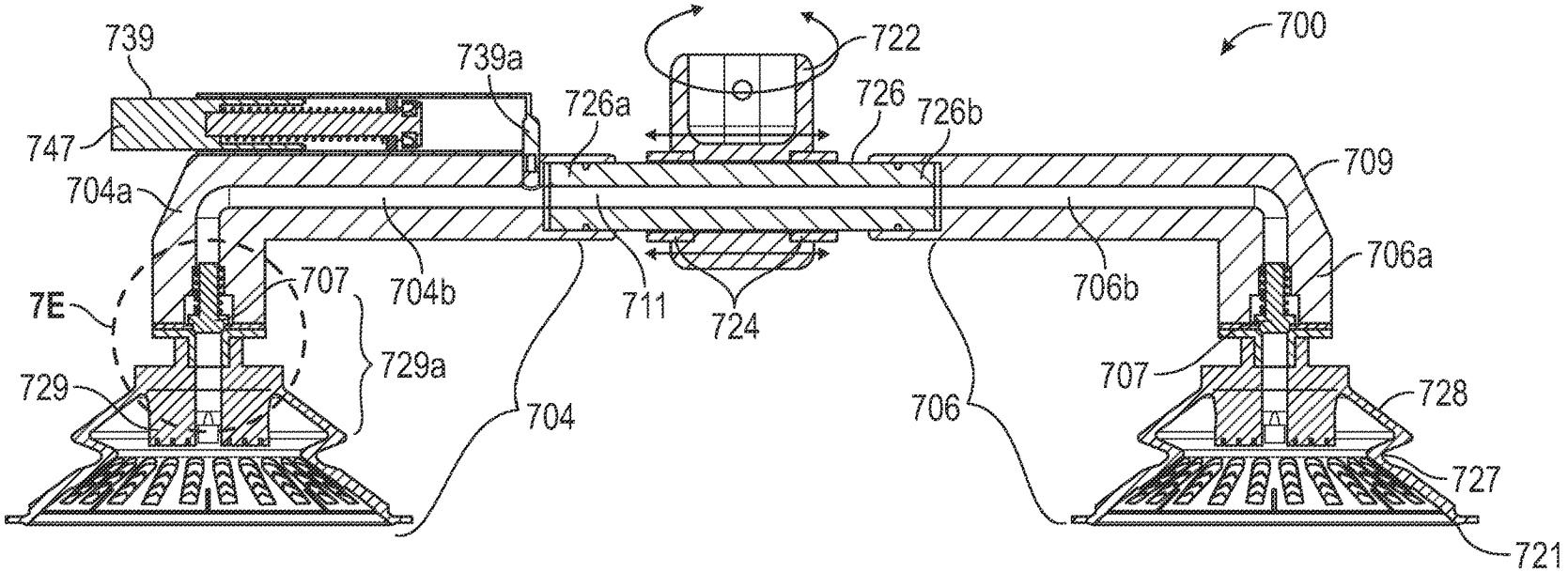
FIG. 7A shows a longitudinal side cross-sectional view of a suction cup apparatus configured for coupling to one or more objects according to embodiments of the disclosure.
Figure 7B:
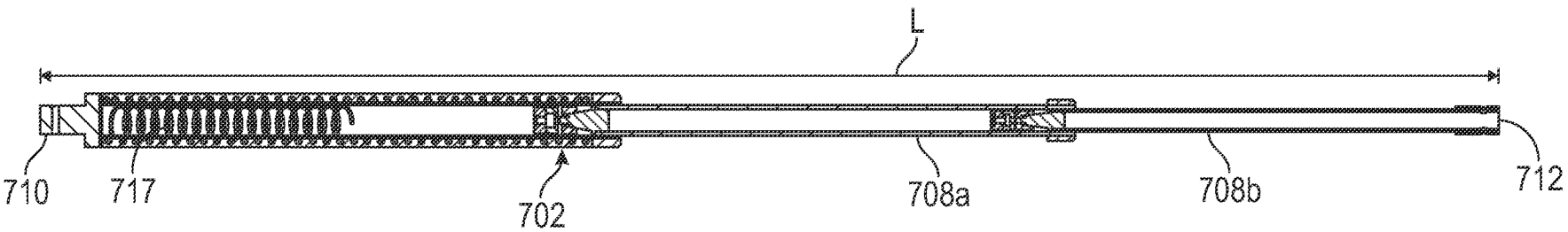
FIG. 7B shows a longitudinal side cross-sectional view of connecting rod useable with a suction cup apparatus according to embodiments of the disclosure.

Referring now to FIGS. 7A, 7B, 7C, 7D, and 7E together, a longitudinal side cross-sectional view of a suction cup apparatus configured for coupling to one or more objects, a longitudinal side cross-sectional view of connecting rod useable with a suction cup apparatus, and a longitudinal side cross-sectional view of the suction cup apparatus of FIG. 7A, an external side cross view of a suction cup apparatus, and a close-up longitudinal side cross-sectional view of a valve arrangement for the suction cup apparatus of FIG. 7A, respectively, illustrative of embodiments disclosed herein, are shown.

FIGS. 7A-7E together show a mooring device (also 'suction cup apparatus') 700 having a frame or main body 709. The frame 709 may be a strut or other suitable elongated member, having a first frame end 704*a* and a second frame end 706*a*. The ends 704*a*, 706*a* may be generally axial or linear to each other; however, as shown here, one or both ends 704*a*, 706*a* may have a bend associated therewith. The frame 709 may be a generally integral component or a combination of (sub)components coupled together.

For example, the frame 709 may have a member or rod 726 having a first rod end 726*a* coupled with a first suction cup head 704. The frame 709 may have another cup head, for example, the rod 726 may have a second rod end 726*b* coupled with a second suction cup head 706. The coupling between the rod 726 and the heads 704, 706 may be press fit, threadingly, securingly, etc. or as may otherwise be needed for the operation of the mooring device 700. To accommodate movement between the rod 726 and the heads 704, 706, there may be one or more bushings 724 coupled therebetween.

The frame 709 with its heads 704, 706 may have one or more suction cups 728 coupled therewith. Any of the cups 728 may have a cup body 729. Any respective cup body 729 may have configured with a bellows fold 727. The use of a bellows fold 727 or the like may facilitate the ability of the cup body 729 (and thus the device 700) to conform to various shapes and surface curvatures of objects to which the device 700 may be attached to. When placed upon a target surface 701 of an object (such as a floating vessel, boat, or the like) 703, the sealing edge 721 may be made to sit flat by compressing the cup body 729 at varying amounts around its circumference.

In embodiments, the frame 709 may house or otherwise couple with a fluid mover or pump 739. The pump 739 may be detachably coupled with the frame 709 in any suitable manner During use, the pump 739 may be useable or securely coupled in a sufficient manner to accommodate creating a vacuum within the device 700. As such the pump 739 and the frame 709 (or device 700) may be configured with inlets, outlets, receptacles, nipples, etc. for coupling theretogether.

In embodiments the pump 739 may be rotatable and positioned while still attached to the frame 709. The pump 739 may have a pump fluid passageway 739*a* positioned or otherwise coupled with the device 700 in manner to be in fluid communication with a frame fluid pathway (which may comprise head fluid pathways 704*b* and/or 706*b*, and rod fluid pathway 711). In this respect, the pump 739 may be operable to remove fluid (air) from the pathway(s) 704*b*, 706*b*, and/or 711, and thus pull a vacuum on the cup(s) 728.

Within an interior portion 729*a* of the cup body 729, there may be a cup fluid pathway 733. The cup fluid pathway 733 may be in fluid communication with the frame pathways, and thus may also be in fluid communication with the pump fluid pathway 739*a*. Within the frame pathway(s) or the cup fluid pathway(s), or at the meeting point therebetween, there may be a valve or other restrictor 707. Each cup 728 may have its own valve 707 as shown, or a single valve may be utilized at the pump as desired by persons having ordinary skill in the art.

Figure 7C:
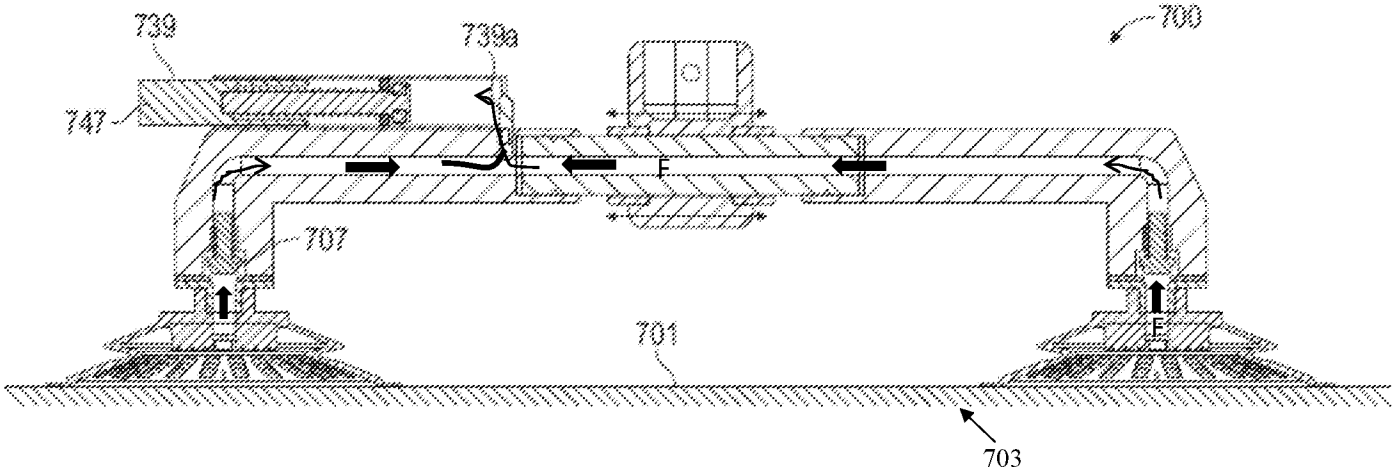
FIG. 7C shows a longitudinal side cross-sectional view of the suction cup apparatus of FIG. 7A coupled to a target surface of an object according to embodiments of the disclosure.
Figure 7D:
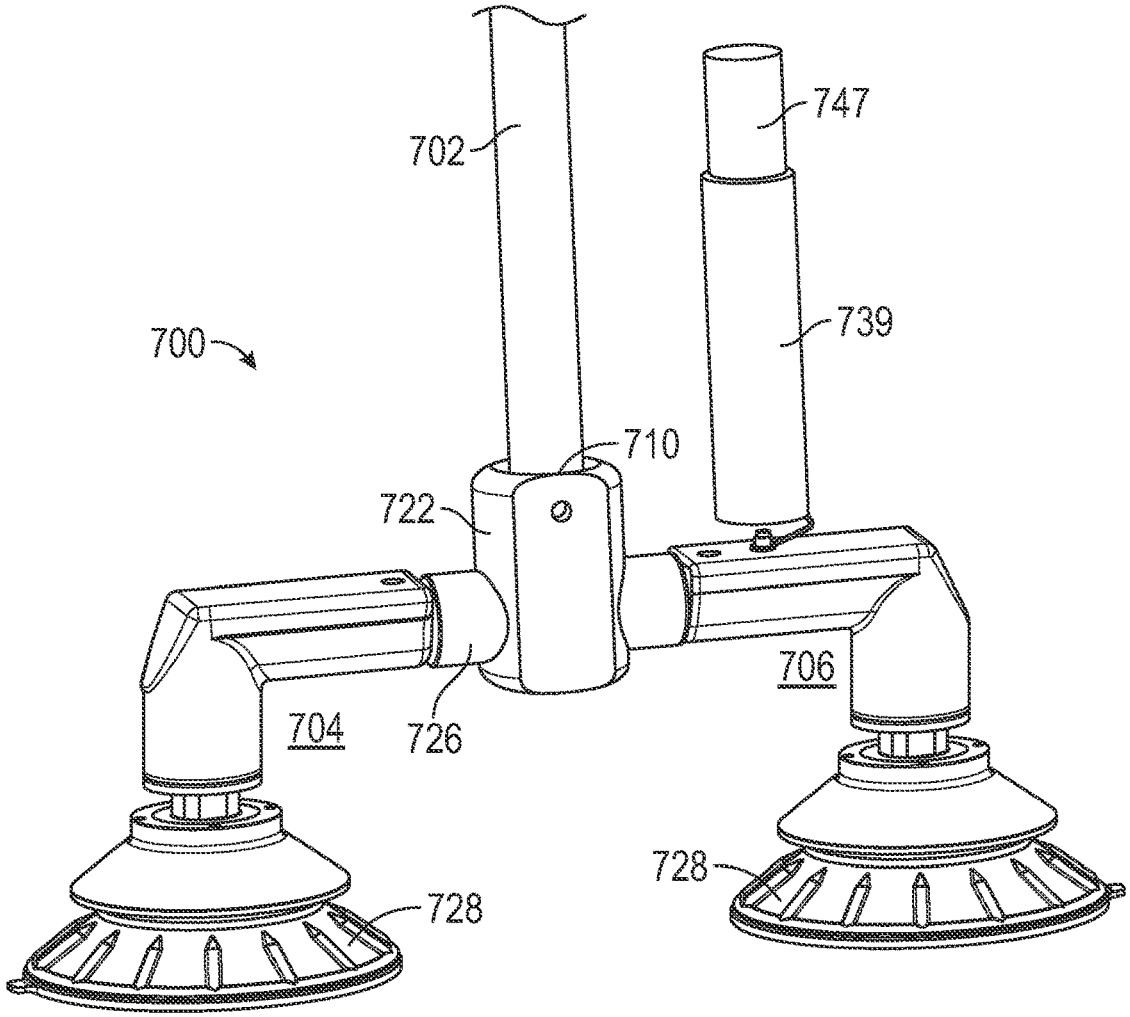
FIG. 7D shows an external side cross view of a suction cup apparatus according to embodiments of the disclosure.
Figure 7E:
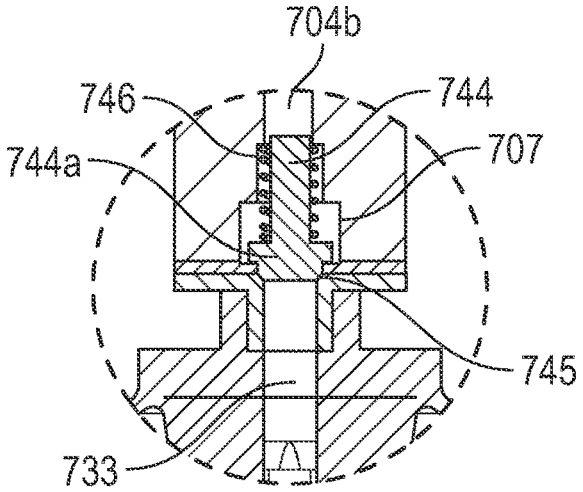
FIG. 7E shows a close-up longitudinal side cross-sectional view of a valve arrangement for the suction cup apparatus of FIG. 7A according to embodiments of the disclosure.

FIG. 7C shows in particular that as a movable member or arm 747 of the pump 739 is moved, there may be a pull or suction created within the pathways 739*a*, 704*b*, 706*b*, 733, and thus space 751. This results in suction between the cup(s) 728 and the target surface 703, as the volume of fluid therebetween is removed. When the arm 747 is stroked back, a valve stem 744 may move into (on, against, etc.) sealing contact with seat 745, and thus restrict fluid from flowing back into space 751. The stem 744 may be biased into engagement with the seat 745 via bias member 746. On the other hand, when the movable member 747 is pulled to create suction, the bias member 746 may be overcome, and fluid communication with all the pathways and the space 751 may occur.

There may be a connecter or coupler 722 coupled with or part of the frame 709. The connector 722 may have varying degrees of movement capability based upon the desired application. As shown here, the connector 722 may movingly engage with the frame 709 (or rod 726). For example, the connector 722 may slide laterally, as well as swivel in a direction orthogonal to the lateral movement, thus having multiple degrees of freedom in its movement.

As part of the device 700, there may be a connecting rod or strut 702 configured for coupling with the frame 709, such as the coupler 722 (which may have a t-branch configuration). The strut 702 may have one or more members coupled together, such as segments 708*a*, 708*b*. The segments may be a first segment 708*a*, and a second segment 70*b*. The segments 708*a*, 708*b* may be movingly (such as telescopingly) engaged together, which may facilitate for adjustment of a length L of the strut 702.

In embodiments the strut 702 may incorporate one or more strut bias members 717 (such as a spring), which may provide a shock absorber effect in the event segments 708*a*, 708*b* may be compressed or otherwise urged together (or one moved inwardly of another). The strut 702 may have a first strut end 710 configured to couple to the connector 722 of the mooring device 700. The strut 702 may have a second connector end 712 configured to connect with another frame/suction cup apparatus. In embodiments, either or both of the ends 710, 712 may be configured for coupling with other items as desired.

Referring now to FIGS. 8A, 8B, 8C, and 8D together, a block diagram view of an object moored with another object, and also optionally moored with yet another object, a side view of a floating vessel coupled with two different objects, a side view of a multi-cup mooring device coupled with a rounded surface of a floating vessel, and a double hook-ended connector rod according to embodiments of the disclosure, respectively, illustrative of embodiments disclosed herein, are shown.

FIGS. 8A-8D together show one or more embodiments and/or uses of a mooring device (also 'suction cup apparatus') 800. While these and other embodiments described herein might make an inference toward use with a floating vessel, the disclosure is not meant to be limited. For example, the object 803 may be coupled with another object 803*a* via a first mooring device 800. The objects may be, for example, the first object may be a truck sidewall or flooring, and the second or other object may be a pallet of goods. In embodiments, the mooring device 800 may be used to secure pallets inside of a tractor trailer and/or inside of a container.

Figure 8A:
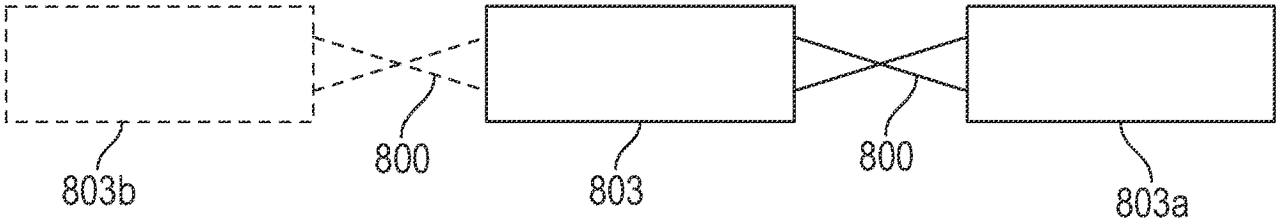
FIG. 8A shows a block diagram view of an object moored with another object, and also optionally moored with yet another object according to embodiments of the disclosure.
Figure 8B:
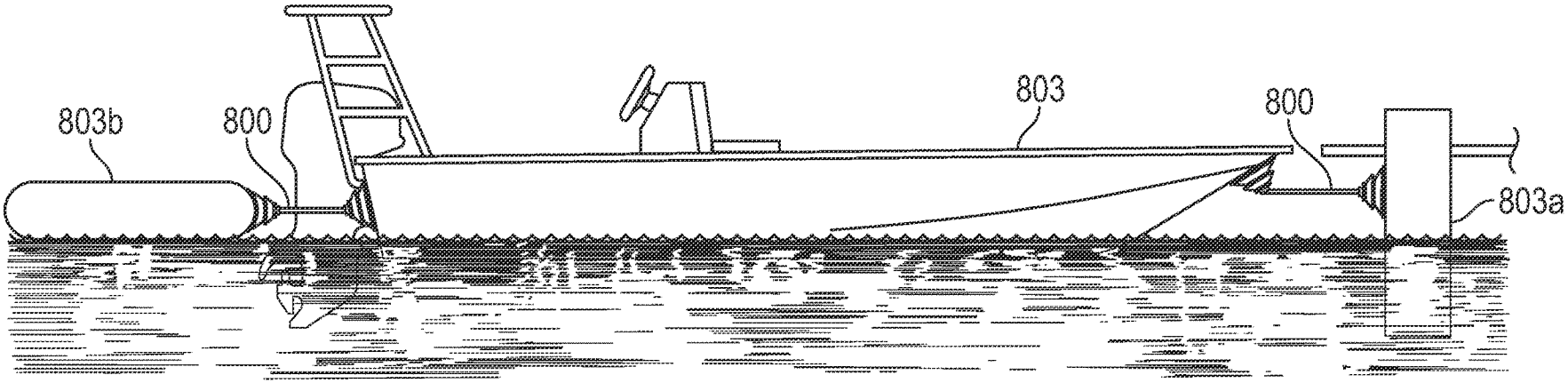
FIG. 8B shows a side view of a floating vessel coupled with two different objects according to embodiments of the disclosure.

The object 803 may be coupled with yet another object, such as second object 803*b*. Thus, a second mooring device 800 (which need not be exactly the same) may be used the coupled the object 803 with a first object 803*a*, and optionally, with another mooring device 800 to a second object 803*b*. FIG. 8B illustrates the first object 803 may be floating vessel, such as a boat or the like. First and second objects 803*a*, 803*b* may be fixed or movable objects, such as a deck or pier, or another floating vessel or object, such as another boat or tube/raft.

Figure 8C:
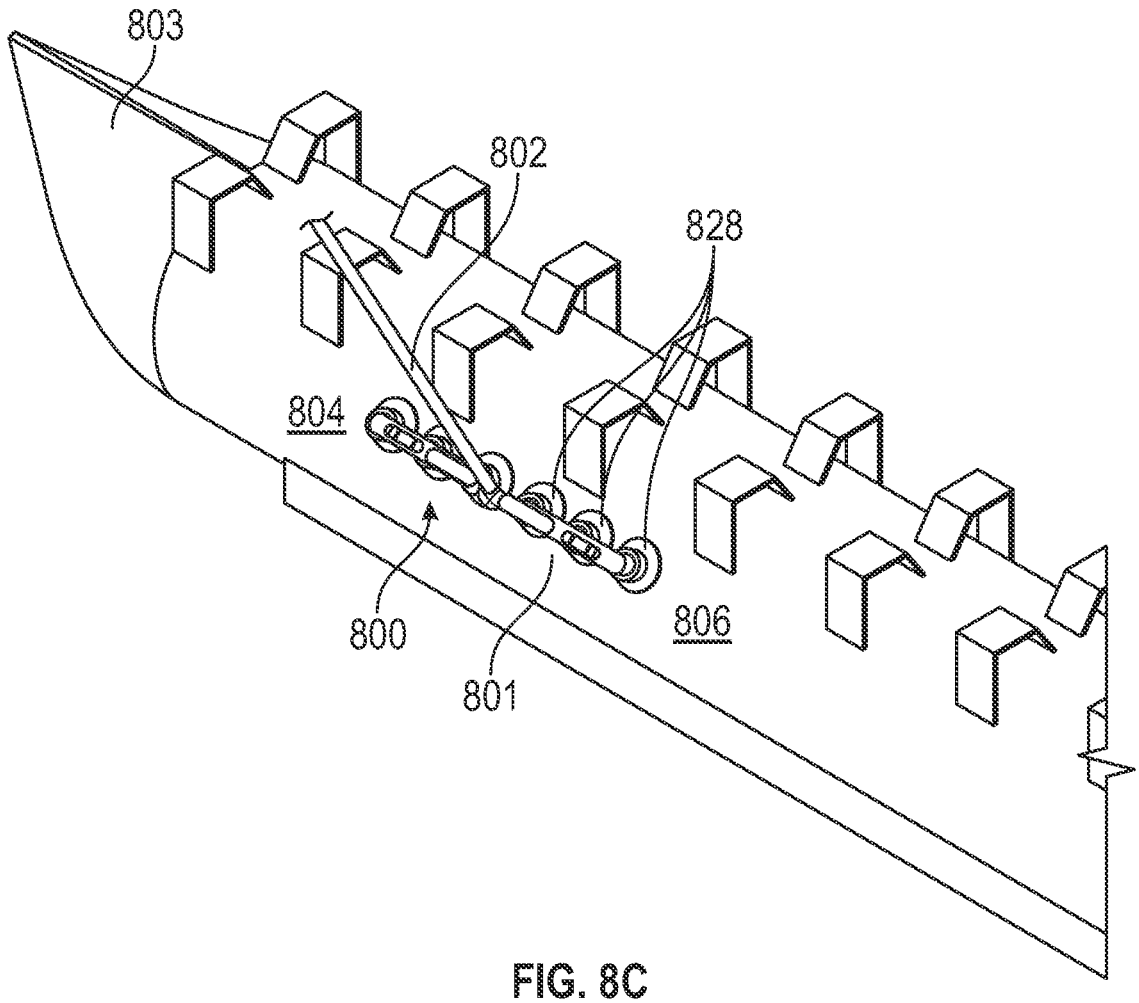
FIG. 8C shows a side view of a multi-cup mooring device coupled with a rounded surface of a floating vessel according to embodiments of the disclosure.

FIG. 8C illustrates a unique advantage of the present disclosure, in that the mooring device 800 may be coupled to a rounded (i.e., non-flat/linear) surface 801, such as a float of a pontoon boat 803. Moreover, FIG. 8C illustrates one or more suction cup heads 804, 806 may have two or more suction cups 828. In addition to a linear arrangement of cups, other arrangements are possible, such as circular, rectangular, or just about any other type of symmetrical or asymmetrical configuration.

Figure 8D:
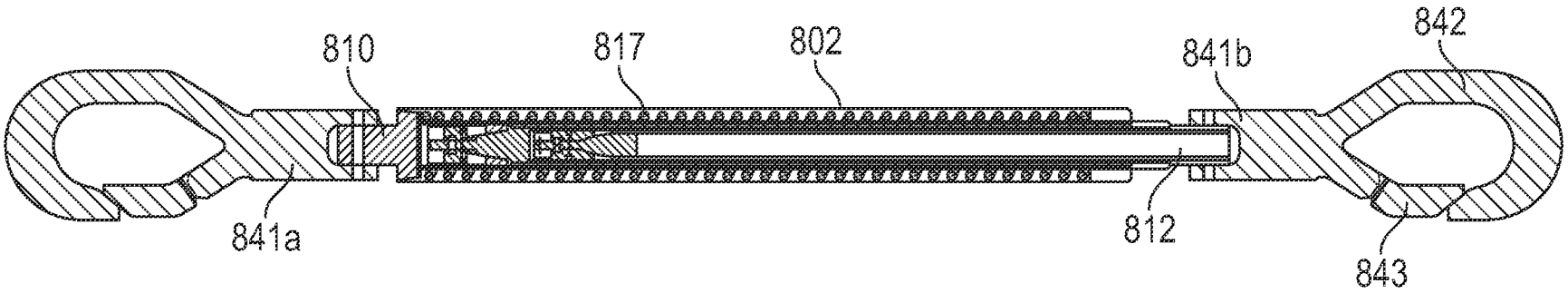
FIG. 8D shows a double hook-ended connector rod according to embodiments of the disclosure.

The connector rod 802 may be coupled with other mooring devices/suction cup heads. Just the same, the connector rod 802 may be coupled with a hook 842 (with respective movable latch 843). For example, FIG. 8D shows the connector rod 802 may have a first end 810 coupled with a first hook mount end 841*a*. The connector rod 802 may have a second end 812 coupled with another or a second hook mount end 841*b*. The connector rod 802 may have a bias member 817, which may be movingly coupled with one or more (telescoping) segments.

The mooring device(s) 800 may be operably configured to keep one or more objects coupled together, even in the presence of disturbance or undesired motion, such as wave motion. The objects may maintain coupling together at approximately a constant distance.

Embodiments disclosed expressly or impliedly herein generally relate to a device or apparatus for connecting objects, even with irregular surfaces, to each other. This may be accomplished while at the same time maintaining a minimum or desired distance between the objects.

A mooring device or suction cup of the present disclosure may a suction cup comprising a cup body, a sealing edge, an internal surface, an external surface, a fluid pathway extending from an interior of the cup body to the exterior of the cup body, and a plurality of cleats positioned on the internal surface of the cup body extending radially inward from proximate the sealing edge. The thickness of each cleat of the plurality of cleats increases distal to the sealing edge.

The suction cup may be made of any material as determined on a per application basis by persons having ordinary skill in the art. Typical materials of construction are rubbers or plastics. It may be desirable to have a material that is substantially impermeable to fluids and also resistant to solvents and chemicals. For example, if used on boats, sea water is extremely corrosive.

The suction cup body may have at least one bellows fold extending around the entire circumference of the cup body. In embodiments, the cup body may have multiple bellows folds. The bellows fold(s) may allow for the cup body to compress in a non-uniform manner such that the cup body does not compress the same amount about its circumference. This allows for the cup body to conform to rounded and/or irregular shapes for attachment and help seat the sealing edge. The external surface of the cup body may have a physical feature, such as a tab, to aid in detaching the suction cup from an object by releasing the vacuum. Various such features or structures are known to persons having ordinary skill in the art for suction cups, and any feature or structure may be used as appropriate.

The sealing edge may be configured to make a substantially hermetic, or fluid tight, seal with a surface. In embodiments, the sealing edge may be flat, chamfered, or radiused as desired by persons having ordinary skill in the art.

A fluid pathway may be included leading from the interior of the cup body to the exterior of the cup body. This may be a simple hole to aid air in egressing the cup body when the suction cup is compressed onto a surface with a plug or flap valve to maintain the seal. In embodiments, a pump may be used to remove air from within the cup body.

In embodiments, the pump may be attached to the suction cup apparatus. Any pump known to persons having ordinary skill in the art may be used. In embodiments, the pump may be a manual pump, a hand operated pump, or a battery-operated or powered pump.

A check valve may be positioned between the pump and the interior of the cup body, allowing egress of air, while preventing ingress. Any known check valve design may be utilized by persons having ordinary skill in the art. In embodiments, a Schrader™ valve (also known as an American valve) may be utilized. These valves are a spring assisted poppet valve, of the type typically used in bicycle tires. This would allow for a bicycle pump style connection to be utilized with a pump capable of pulling a vacuum to create suction and attach the suction cup to a surface. Any pump capable of drawing vacuum may be utilized.

The internal surface of the cup body may have one or more cleats. The cleats may be radially oriented, leading inward from the sealing edge. In embodiments, the thickness of the cleat may increase further away from the sealing edge. The cleats may help the suction cup seal more effectively on a surface.

Because the thickness of the cleats increases further away from the sealing edge, this creates a greater void volume between the cleats radially inward from the sealing edge. This creates a desirable pressure gradient within the cup, leading to a more effective seal. Further, this helps the suction cup grip more effectively when air is pumped out of the cup, as this increases the vacuum at the sealing edge.

The cleat may have one or more indentations to allow for greater air flow. The indentations may be of any shape as desired by persons having ordinary skill in the art. In embodiments, the indentation may be a zigzag shape, such as a chevron, to aid in air flow.

In embodiments, the suction cup may be attached to a frame having a connector. The frame may be any structure attached to the suction cup which allows for supporting a connector and joining to a connecting item. In embodiments, a portion of the connector may also serve as the frame. For example, if a ball and socket joint is used as a connector, the socket of the joint may itself serve as the frame when attached to the suction cup.

The frame may allow for multiple suction cups to be supported to allow for redundancy and additional grip strength. In embodiments, the frame may also store a pump. The pump may be detachable for use, or already positioned in fluid communication with the interior of the cup body. In embodiments, a void, or secondary fluid pathway may be contained within the frame to be in communication with the fluid pathway of the suction cup and the pump. One or more check valves may also be positioned within such a secondary fluid pathway.

The connector may be adapted to receive and grasp one end of a connecting item, such as a connecting rod, a connecting chain, or a connecting rope. Persons having ordinary skill in the art may determine the appropriate connector based upon the specific application.

Exemplary connectors include a ball and socket joint, a pin joint, a knuckle joint, and the like. Various connectors and fastening means are known to persons having ordinary skill in the art and it is not intended for this disclosure to be limited to any specific connector.

It is desirable for the connector to allow for a degree of motion of the connecting item with respect to the frame. In embodiments, therefore, the connector pivots to allow for some predetermined degree of motion between the items being connected. For example, the connector may incorporate a flexible stem allowing for a limited range of movement. Other exemplary embodiments include a ball and socket joint or a sliding bar, which may allowed a range of rotation. For the purposes of this disclosure, pivoting of the connector shall refer to allowing for a range of motion of the connecting item relative to the frame. The actual range of motion may be determined by persons having ordinary skill in the art based upon the specific application. For example, when connecting two items together where it is undesirable for the items to contact one another (such as boats), the pivoting range of the connector may be limited to a maximum of sixty degrees in any given direction. However, when connecting to items of irregular shapes and/or sizes, or needing flexibility with orienting the suction cup body, persons having ordinary skill in the art may determine that a much greater pivoting range, such as one hundred eighty degrees, or more, may be necessary.

A first end of the connecting rod may be received within the connector. In embodiments, the connecting rod may be telescoping to adjust for a range of lengths. In embodiments, the connecting rod may also incorporate a bias, such as a spring, to allow the connecting rod to act as a shock absorber if connected items move toward one another.

A second end of the connecting rod may be adapted to be received by the connector of another suction cup apparatus or have a means of attachment such as a hook or carabiner clip. Various items may be connected to the second end of the connecting rod. A non-exhaustive exemplary list includes: a hook, a carabiner clip, a drink holder, a brace (for boxes, crates, and the like), a tie off (allow a rope to be tied to the connector), a carrying handle, and the like.

Embodiments herein may pertain to a method of using any mooring device or suction cup apparatus of the present disclosure. The mooring device may have or may be coupled with a fluid mover, such as a pump. The pump may be operable to pull a suction through one or more fluid pathways of the mooring device. As fluid, such as air, may be suctioned or otherwise moved out of the mooring device, a vacuum may be created between an underside of a suction cup and a target surface.

The method may include engaging the suction cup to the target surface, whereby an entire sealing surface of the cup may be in contact with the target surface. The method may include forming sealing engagement with the mooring device (and one or more of its cups) and the target surface of a respective object. For example, a side surface of a hull of a boat.

The method may include restricting flow back into the cub underside, such as with a check valve or the like. The method may include coupling the mooring device with another object, such as deck or another boat.

Advantages

Embodiments herein may beneficially pertain to being able to couple one or more objects together without worrying about the objects colliding together and causing damage.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

It is understood embodiments described herein are only illustrative of the application of the principles of the present disclosure, as there may be other embodiments in other specific forms without departing front its spirit or essential characteristics. The described embodiments are to be considered in all respects only as illustrative and not restrictive.

For example, although the parts are designed to be resistant to conditions seen on or near the water, such as salt, water, wind, and sun, other embodiments may be useful on land or in enclosed structures, wherein connecting structures such as bearings and ball joints may be in place of pin connections and bushings or rods to provide additional movement without the risk of premature degradation. Additionally, although the figures may illustrate suction cups to attach relatively smooth and uniform surfaces to one another, the suction cups or the first or second head may be replaced by rings, hooks, clamps, pins, brackets, clasps, or other fasteners known to a person skilled in the art so that the mooring device may be affixed to cleats, rails, towers, hooks, loops, or other desired structures. It is also envisioned that the central support need not be a rigid material, so that the mooring device may be used for towing a boat or other object without the directional movement limitations that rigid structure brings.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A mooring device comprising:

a rod having a first rod end and a second rod end;

a first suction cup assembly comprising:

a first suction cup mount having a first mount end and a second mount end, the first mount end coupled with the first rod end;

a first suction cup coupled with the second mount end;

a coupler engaged with the rod, the coupler configured for at least one of lateral movement with respect to the rod, rotational movement with respect to the rod, and combinations thereof;

wherein the rod comprises a rod fluid pathway, the first suction cup mount comprises a mount fluid pathway, and the first suction cup comprises a cup fluid pathway, and wherein each of the rod fluid pathway, the mount fluid pathway, and the cup fluid pathway are in fluid communication with each other depending on a position of a valve.

2. The mooring device of claim 1, wherein a pump is coupled to the mooring device, and suction is used to move the valve to a flow position, whereby fluid may flow through each of the rod fluid pathway, the mount fluid pathway, and the cup fluid pathway.

3. The mooring device of claim 1, wherein a second suction cup assembly is engaged with the second rod end.

4. The mooring device of claim 1, the mooring device further comprising an at least one bushing disposed around the rod, and engaged with the coupler.

5. The mooring device of claim 1, the mooring device further comprising a strut having a first strut end engaged with the coupler.

6. The mooring device of claim 5, wherein the strut comprises a first segment and a segment telescopingly engaged together.

7. The mooring device of claim 5, wherein the strut has a second strut end engaged with another coupler associated with a second suction cup assembly.

8. The mooring device of claim 5, wherein the strut has a second strut end engaged with another coupler associated with a hook.

9. The mooring device of claim 1, wherein the suction cup further comprises:

a cup body having at least one bellows fold extending around an entire circumference of the cup body;

a sealing edge;

an internal surface; and a plurality of cleats positioned on the internal surface of the cup body extending radially inward from proximate the sealing edge, wherein the thickness of each cleat of the plurality of cleats increases distal to the sealing edge, and wherein the cup fluid pathway extends from an interior underside of the cup body to an exterior of the cup body.

10. The mooring device of claim 1, wherein a detachable pump is coupled with the mooring device, and operated to create a vacuum within the fluid pathways whereby an external surface of the suction cup is coupled with a first floating vessel.

11. A mooring device comprising:

a rod having a first rod end and a second rod end;

a first suction cup assembly comprising:

a first suction cup mount having a first mount end and a second mount end, the first mount end coupled with the first rod end;

a first suction cup coupled with the second mount end;

a coupler engaged with the rod, the coupler configured for at least one of lateral movement with respect to the rod, rotational movement with respect to the rod, and combinations thereof;

wherein the rod comprises a rod fluid pathway, the first suction cup mount comprises a mount fluid pathway, and the first suction cup comprises a cup fluid pathway, wherein each of the rod fluid pathway, the mount fluid pathway, and the cup fluid pathway are in fluid communication with each other depending on a position of a valve.

12. The mooring device of claim 11, wherein a pump is coupled to the mooring device, and suction is used to move the valve to a flow position, whereby fluid may flow through each of the rod fluid pathway, the mount fluid pathway, and the cup fluid pathway.

13. The mooring device of claim 12, wherein the mooring device further comprises:

a second suction cup assembly is engaged with the second rod end;

an at least one bushing disposed around the rod, and engaged with the coupler; and a strut having a first strut end engaged with the coupler.

14. The mooring device of claim 13, wherein the strut comprises a first segment and a second segment telescopingly engaged together.

15. The mooring device of claim 14, wherein the strut has a second strut end engaged with another coupler associated with a second suction cup assembly.

16. The mooring device of claim 15, wherein the suction cup further comprises:

a cup body having at least one bellows fold extending around an entire circumference of the cup body;

a sealing edge;

an internal surface; and a plurality of cleats positioned on the internal surface of the cup body extending radially inward from proximate the sealing edge, wherein the thickness of each cleat of the plurality of cleats increases distal to the sealing edge, and wherein the cup fluid pathway extends from an interior underside of the cup body to an exterior of the cup body.

17. The mooring device of claim 16, wherein a detachable pump is coupled with the mooring device, and operated to create a vacuum within the fluid pathways whereby an external surface of the suction cup is coupled with a first floating vessel.

18. A mooring device comprising:

a rod having a first rod end and a second rod end;

a first suction cup assembly comprising:

a first suction cup mount having a first mount end and a second mount end, the first mount end coupled with the first rod end;

a first suction cup coupled with the second mount end;

a second suction cup assembly comprising:

a second suction cup mount having a respective first mount end and a respective second mount end, the respective first mount end coupled with the second rod end;

a second suction cup coupled with the respective second mount end;

a coupler engaged with the rod, the coupler configured for at least one of lateral movement with respect to the rod, rotational movement with respect to the rod, and combinations thereof;

a strut having a first strut end engaged with the coupler;

wherein the rod comprises a rod fluid pathway, the first suction cup mount comprises a mount fluid pathway, and the first suction cup comprises a cup fluid pathway, wherein each of the rod fluid pathway, the mount fluid pathway, and the cup fluid pathway are in fluid communication with each other depending on a position of a valve, and wherein a detachable pump is coupled with the mooring device, and operated to create a vacuum within the fluid pathways whereby an external surface of the first suction cup is sealingly coupled with a target surface of a first object.

19. The mooring device of claim 18, wherein an at least one bushing is disposed around the rod, and engaged with the coupler, and wherein the strut comprises a first segment and a second segment telescopingly engaged together.

20. The mooring device of claim 19, wherein the suction cup further comprises:

a cup body having at least one bellows fold extending around an entire circumference of the cup body;

a sealing edge;

an internal surface; and a plurality of cleats positioned on the internal surface of the cup body extending radially inward from proximate the sealing edge, wherein the thickness of each cleat of the plurality of cleats increases distal to the sealing edge, and wherein the cup fluid pathway extends from an interior underside of the cup body to an exterior of the cup body.

* * * * *